United States Patent [19]

Erlandson et al.

[11] Patent Number: 4,909,518

[45] Date of Patent: Mar. 20, 1990

[54] WATER BALLOON GAME

[75] Inventors: David L. Erlandson, Brainerd; Thomas F. Woog, Cross Lake, both of Minn.

[73] Assignee: T & D Enterprises of Brainerd, Inc., Brainerd, Minn.

[21] Appl. No.: 383,926

[22] Filed: Jul. 21, 1989

[51] Int. Cl.[4] ..... A63F 9/02

[52] U.S. Cl. ..... 273/357; 124/17; 273/317; 273/355

[58] Field of Search ..... 273/317, 355, 356, 357, 273/428; 124/17

[56] References Cited

U.S. PATENT DOCUMENTS 4,240,396 12/1980 Randoll ..... 273/428 X
4,243,220 1/1981 Shelley ..... 273/1 G
4,684,137 8/1987 Armer, Jr. et al. ..... 273/428

*Primary Examiner*—Anton O. Oechsle
*Attorney, Agent, or Firm*—Kinney & Lange

[57] ABSTRACT

A game participant enclosure for a water balloon game includes a plurality of side walls and an overhead protector and water balloon engager supported by the side walls. The protector and engager includes a water balloon opening sufficiently large for a water balloon to pass therethrough from the interior of the enclosure and a plurality of water openings sufficiently small to prevent water balloons from entering the enclosure. A water balloon launcher is disposed within the enclosure such that water balloons are launchable through the water balloon opening. In one aspect of the invention, two such enclosures are positioned a selected distance from each other and water balloons are launched from one enclosure to the other to splash the participants in the opposing enclosure.

11 Claims, 3 Drawing Sheets

WATER BALLOON GAME

BACKGROUND OF THE INVENTION

1. Field of the Invention.

The present invention relates to games, and in particular, it relates to a water balloon game and enclosure for playing a water balloon game.

2. Description of the Prior Art.

The filling of balloons with water and tossing the filled balloons at others is well known and is considered an enjoyable pastime by most.

Patents that describe the use of a fluid filled balloon include the Armer, Jr. et al U.S. Pat. No. 4,684,137 and the Shelley U.S. Pat. No. 4,243,220. The Armer, Jr. et al patent describes the use of balloons which contain a slurry having a marking agent. The balloons are shot from weapon-like devices at opposing participants or targets, marking the participant. The Shelley patent describes a game device for bursting balloons with pressurized water that are suspended over players participating in the gae. Water is incrementally introduced into the balloons hanging over the participants until the balloon bursts, wetting the participant.

The launching of water balloons using a launcher is described in U.S. Pat. No. 4,240,396. The launcher is in the form of a sling-shot and is operable by three people. Two people hold elastic strings that are secured t a water balloon holder, while the third person draws back the water balloon holder to launch the balloon.

SUMMARY OF THE INVENTION

The present invention includes a game participant enclosure for a water balloon game that has a plurality of side walls and an overhead participant protector and water balloon engager supported by the side walls. The protector and engager has a water balloon opening sufficiently large for launching a water-balloon therethrough and a plurality of openings sufficiently small to prevent water balloons from entering the enclosure. A water balloon launcher is disposed within the enclosure such that water balloons are launchable through the water balloon opening.

The present invention also includes a game wherein two game participant enclosures are spaced apart from each other a selected distance. Participants in each enclosure launch water balloons at each other. The water balloons burst on the overhead protector with water falling on the participants within the enclosure through the openings of the protector.

Preferably, the side walls are made of a mesh material, such as chain length fencing, so that water balloons hitting the sides of the enclosure also burst while permitting water to enter into the enclosure splashing the participants. In addition, the overhead protector has a series of openings varying in size, varying the effect of the water splashing on the participants in the enclosure.

BRIEF DESCRIPTION OF THE INVENTION

DETAILED DESCRIPTION OF THE PREFERRED EMBODIMENTS

Figure 2:
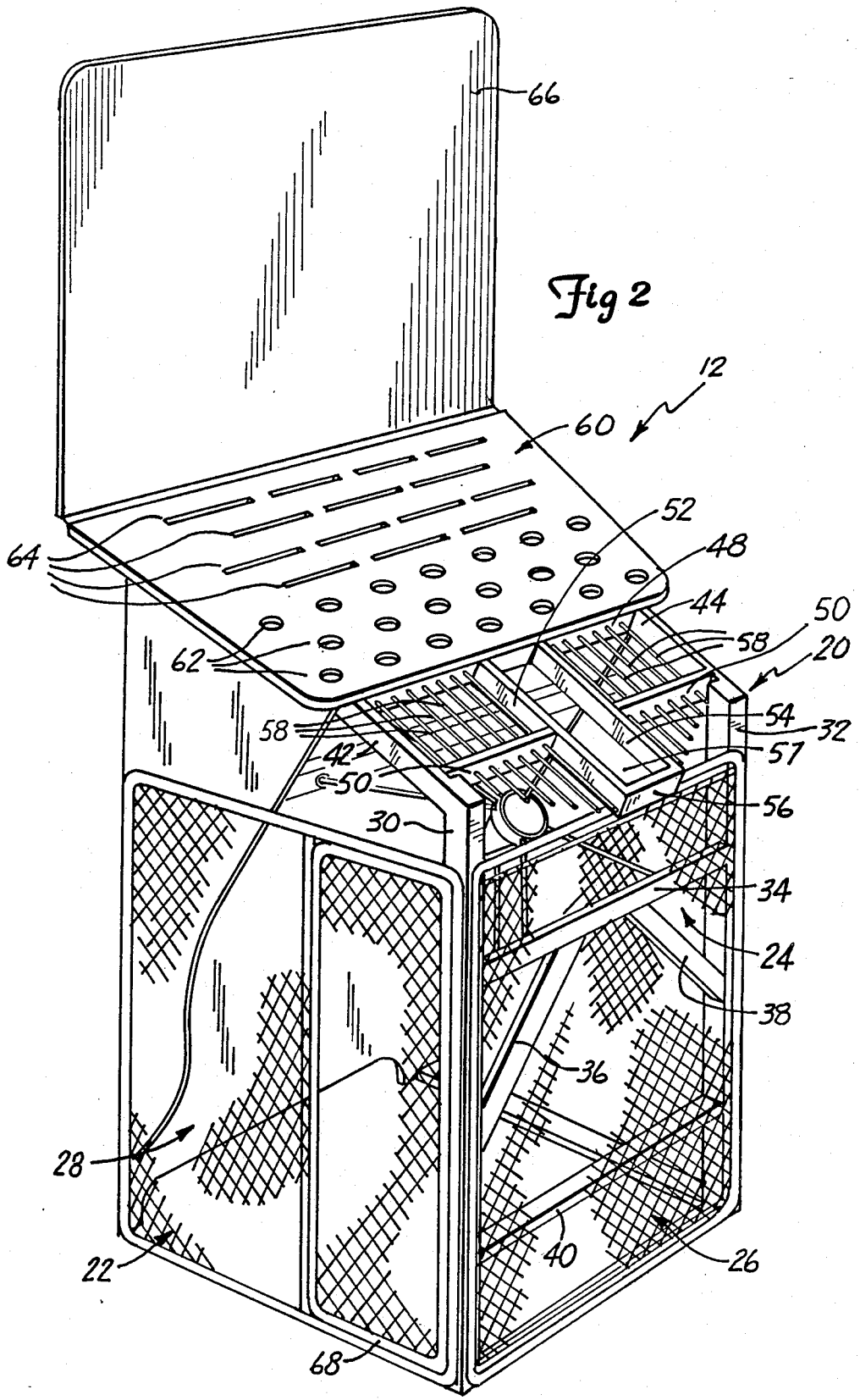
FIG. 2 is a perspective view of the game enclosure of the present invention.

The game of the present invention is generally indicated at 10 in FIG. 2. The game 10 includes first and second enclosures 12 and 14, respectively. The enclosures are positioned a selected spaced-apart distance from each other. Participants in each enclosure launch water balloons 16 and 18 from within each enclosure at the other enclosure. The enclosures are configured so that the participants are protected from a direct hit by a water balloon, but are configured to burst the balloons and permit water to splash on the participants within the enclosure.

Referring to FIG. 2, wherein only the game enclosure 12 is illustrated in enlarged detail. The game enclosure 14 is substantially the same in detail as the game enclosure 12, and therefore only one enclosure will be described in detail. The game enclosure 12 includes a supporting framework 20. The supporting framework 20 supports left and right protective panels 22 and 24, respectively, and a front protective panel 26. A solid rear panel 28 completes the four sides of the enclosure 12. The particular configuration of the framework is unimportant to the present invention except that it provides sufficient support for the elements necessary to play the game of the present invention. Consequently, it may take on different shapes than specifically illustrated and described.

Figures 3, 4:
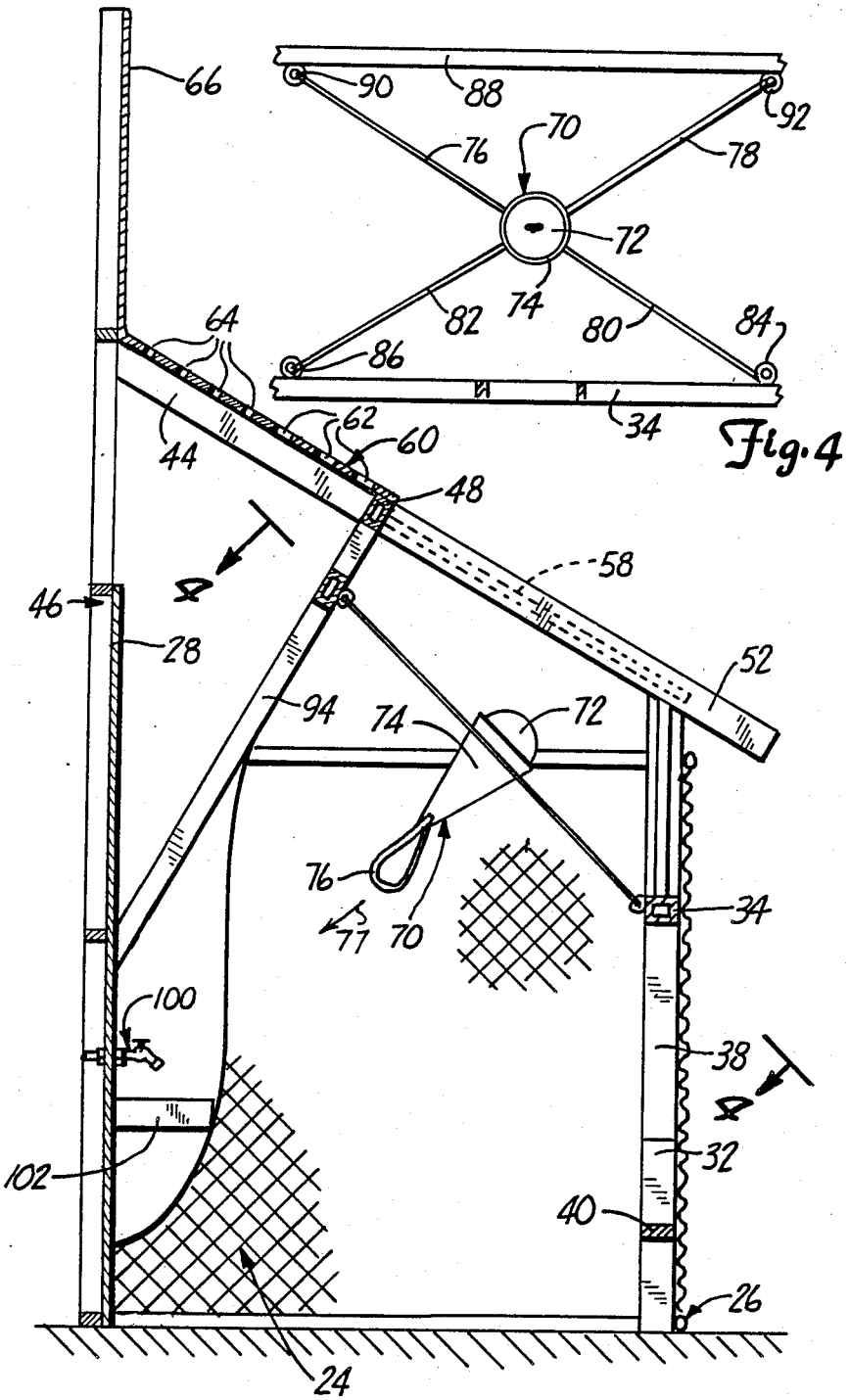
FIG. 3 is a sectional view of an enclosure of the present invention.
FIG. 4 is a sectional view taken along the line 4–4 in FIG. 3.

In the specific embodiment illustrated in FIG. 2, the left and right support posts 30 and 32, respectively, and a rear framework 46, as best illustrated in FIG. 3, provide vertical support for the enclosure. The left and right support posts 30 and 32 are connected to each other by an upper cross beam 34 and left and right struts 36 and 38 which provide further support. A lower cross beam 40 also connects the left and right support posts 30 and 32. Left and right rafter members 42 and 44 join left and right support posts 30 and 32 to the back framework 46. The back panel member 28 is attached to the framework 46, as best illustrated in FIG. 3. The framework 46 is of conventional construction whose purpose is to support the panel 28 and provide a structurally sound framework.

The rafter members 42 and 44 are further joined to each other by rafter cross members 48 and 50. Rafter cross member 50 is interrupted by inner rafter members 52 and 54 which are joined at a front end by a joining member 56. A mid portion of rafter 48 joins the members 52 and 54 at a back nd. The members 52, 54, 56, and the mid portion of rafter 48 define a water balloon opening 57.

A plurality of forwardly extending bars 58 extend from the rafter member 48 through the rafter member 50 approximately up to the font panel 26. The bars 58 are spaced apart a selected distance but not a distance great enough for a water balloon to pass through the bars without bursting. The bars 58 are disposed on either side of the water balloon opening 57.

An overhead protective panel 60 is positioned rearwardly of the water balloon opening 57 and extends rearwardly to the back support panel 28 and the framework 46, as best illustrated in FIG. 3. The panel 60 includes a series of apertures 62 and a series of slots 64. The apertures 62 and the slots 64 are of a size that prevent the entry of a water balloon from the outside into the interior of the enclosure, but permit water to fall uon the participants within the enclosure with varying effect.

A generally upright panel 66 is disposed at the back of the enclosure and extends upwardly from the rear of the panel 60. The panel 66 acts as a backstop for water balloons whose trajectory would otherwise carry the balloon beyond the enclosure. In addition, the panel 66 is used as a display for signage and other graphics.

The panels 22, 24, and 26 are covered with mesh material such as chain link fencing, which acts as a protective barrier so that participants within the enclosure are not hit directly by water balloons. The chain link fening, however, permits the water from the water balloons to splash the participants within the enclosure. Furthermore, the mesh of panels 22, 24, and 6 provides ventilation within the enclosure.

The side panel 22 also includes a door 68 for entry and exist of the enclosure by participants. The door 68 is also covered with mesh such as chain link fencing. The panels 22, 24, and 26 have a perimeter made of steel tubing (although other materials may be used) to support the chain link fencing.

The enclosure 12 is preferably situate on a substantially level concrete slab. Adequate drainage is needed if the enclosure is used for an extended period of time due to the amount of water that may enter the enclosure. In one working embodiment, the enclosure is approximately six by six feet square. The enclosure has a capacity for a maximum of five people. The framework is made of either cedar or redwood for minimum maintenance. All metal is preferably galvanized to minimize corrosion.

The enclosure of the present invention includes a launching mechanism 70 for the launching of water balloons 72 through the opening 57. The launching mechanism 70 includes a water balloon holder 74 and a handle portion 76 disposed rearwardly, that is on a side opposite the balloon 72.

As best illustrated in FIG. 4, the launching mechanism 70 further includes four sections of elastic tubing 76, 78, 80, and 82. Forward tubing sections 82 and 80 are attached, such as by eye bolts 84, 86 to the upper cross member 34. The rearward tubing sections 76 and 78 are attached to a rearward cross member 88 by eye bolts 90 and 92. The rearward cross member 88 is attached to left and right strut members 94 (with only the right strut member being illustrated in FIG. 3), that extend from the back framework 46 at a lower end to the rafters 42 and 44, respectively. It will be appreciated, that the tubing sections 76, 78, 80, and 82 may in practice be two sections of rubber tubing with the two sections of rubber tubing extending through suitable apertures in the holder 78 and thereby being attached to the holder 74 by virtue of extending through such apertures. The tubing may be made of any suitable elastic tubing such as is commonly referred to as surgical tubing.

As will be appreciated, a participant in the enclosure places a water balloon 72 into the holder 74 as illustrated in FIG. 3 and pulls back on the holder by grasping the handle 76 as indicated by arrow 77. The water balloon then exists the enclosure through the water balloon hole 57.

The enclosure further includes a source of pressurized water 100 and a shelf 102 for storing water balloons until needed.

Figure 1:
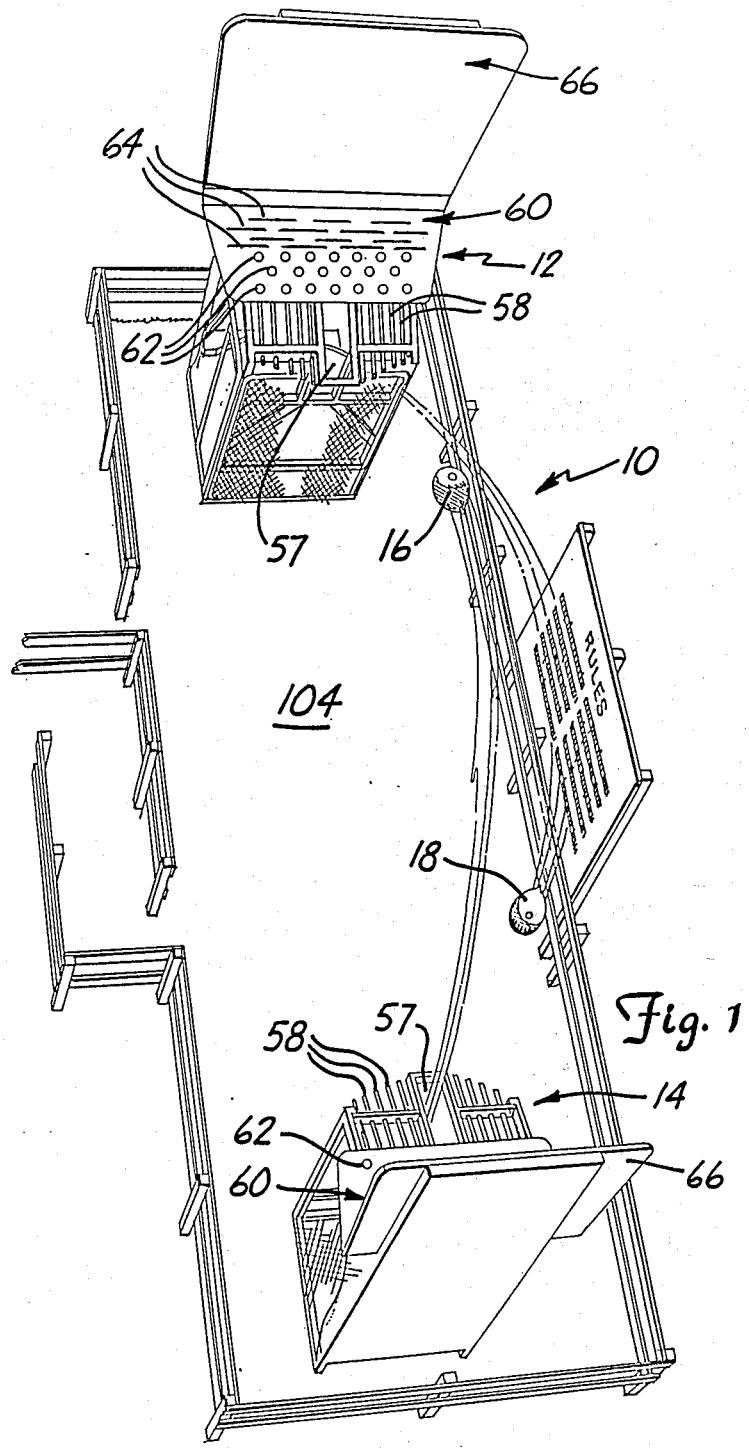
FIG. 1 is a perspective view of the game of the present invention.

Referring back to Figure 1, the enclosures 12 and 14 are positioned in a playing area 104 facing each other. A suitable ground space has been found to be 54 feet in length by 14 feet wide. Participants enter their respective enclosures and fill balloons with water as discussed previously. The balloons are then launched using the launching mechanism of FIGS. 3 and 4 at the opposing enclosure through the water balloon opening 57.

It will be appreciated that a water balloon striking the front of an enclosure will splash the participants within the enclosure in a different manner than a balloon hitting the bars 58, or the apertures 62, or the slots 64. The panels 66 on each of the enclosures 12 and 14 stop balloons which have been over-launched and would otherwise fall beyond the enclosure. The balloons hit the panel 66 and break and the water rolls down on the overhead panel 60 and on to the participants in the enclosure through the slots 64.

Although the present invention has been described with reference to preferred embodiments, workers skilled in the art will recognize that changes may be made in form and detail without departing from the spirit and scope of the invention.

What is claimed is:

1. A game participant enclosure for a water balloon game for use by at least one participant comprising:

a plurality of side walls;

an overhead protector and water balloon engager supported by the side walls and having a water balloon opening sufficiently large for a water balloon to pass therethrough and a plurality of water openings sufficiently small to prevent water balloons from entering the enclosure; and a water balloon launcher disposed within the enclosure such that water balloons are launchable through the water balloon opening.

2. The enclosure of claim 1 wherein the overhead protector includes a city of series of water openings, each series of water openings varying in size to vary the effect of water splashing on the participant within the enclosure.

3. The enclosure of claim 2 wherein the side walls include a mesh-type material that prevents water balloons from passing into the enclosure but permits water to pass therethrough and splash on to the participant.

4. The enclosure of claim wherein the water balloon launcher includes a water balloon holder and elastic tubing attaching the water balloon holder to the enclosure.

5. The enclosure of claim 4 wherein the water balloon launcher further includes a handle portion for grasping by the participants to pull back the water balloon launcher to launch a water balloon.

6. A water balloon game apparatus for use by participants comprising:

first and second enclosures, each enclosure having a plurality of side walls, an overhead protector and water balloon engager supported by the side walls and having a water balloon opening and a plurality of water openings sufficiently small to prevent water balloons from entering the enclosure, and a water balloon launcher disposed within the enclosure such that water balloons are launchable through the water balloon opening; and wherein the first and second enclosures are positioned a selected distance from each other such that water balloons are launchable between the enclosures at an opposing enclosure to splash participants with water within the enclosure.

7. The apparatus of claim 6 wherein the overhead protector includes a plurality of series of water openings of varying size that vary the effect of water splashing on the participants within the enclosure.

8. The apparatus of claim 7 wherein the side walls include a mesh-type material that prevents water balloons from passing into the enclosure but permits water to pass therethrough and splash on to the participants.

9. The apparatus of claim 6 wherein the water balloon launcher includes a water balloon holder and elastic tubing attaching the water balloon holder to the enclosure.

10. The enclosure of claim 9 wherein the water balloon launcher further includes a handle portion for grasping by the participants to pull back the water balloon launcher to launch a water balloon.

11. A water balloon game comprising:

positioning participants in first and second spaced apart enclosures that have water openings that prevent the passage of water balloons into an interior of each enclosure but permit the passage of water such that the participants in the enclosure are splashed;

launching water balloons by the participants from the interior of the enclosures through a water balloon passage in the enclosure and at the opposing enclosure.

* * * * *

UNITED STATES PATENT AND TRADEMARK OFFICE

CERTIFICATE OF CORRECTION

PATENT NO. : 4,909,518

DATED : March 20, 1990

INVENTOR(S) : David Erlandson et al.

It is certified that error appears in the above-identified patent and that said Letters Patent is hereby corrected as shown below:

Column 4, line 35, delete "city" and insert --plurality--.

Signed and Sealed this

Second Day of April, 1991

*Attest:*

HARRY F. MANBECK, JR.

*Attesting Officer*

*Commissioner of Patents and Trademarks*